US010977971B2

(12) United States Patent
Hu et al.

(10) Patent No.: US 10,977,971 B2
(45) Date of Patent: Apr. 13, 2021

(54) DRIVING MODULE USED FOR DISPLAY PANEL, DISPLAY PANEL AND DISPLAY DEVICE

(71) Applicants: Hefei BOE Optoelectronics Technology Co., Ltd., Anhui (CN); BOE TECHNOLOGY GROUP CO., LTD., Beijing (CN)

(72) Inventors: Lingxiao Hu, Beijing (CN); Xiang Wang, Beijing (CN)

(73) Assignees: Hefei BOE Optoelectronics Technology Co., Ltd., Anhui (CN); BOE Technology Group Co., Ltd., Beijing (CN)

( * ) Notice: Subject to any disclaimer, the term of this patent is extended or adjusted under 35 U.S.C. 154(b) by 198 days.

(21) Appl. No.: 16/328,610

(22) PCT Filed: May 15, 2018

(86) PCT No.: PCT/CN2018/086841
§ 371 (c)(1),
(2) Date: Feb. 26, 2019

(87) PCT Pub. No.: WO2018/219136
PCT Pub. Date: Dec. 6, 2018

(65) Prior Publication Data

US 2021/0012691 A1 Jan. 14, 2021

(30) Foreign Application Priority Data

Jun. 2, 2017 (CN) ..... 201710408231.X

(51) Int. Cl.
*G09G 3/32* (2016.01)
*G09G 3/00* (2006.01)
*G09G 3/36* (2006.01)

(52) U.S. Cl.
CPC ..... *G09G 3/006* (2013.01); *G09G 3/3677* (2013.01); *G09G 2300/0408* (2013.01);
(Continued)

(58) Field of Classification Search
CPC .. G09G 3/3648; G09G 3/3266; G09G 3/3677; G09G 3/006; G09G 2300/0408;
(Continued)

(56) References Cited

U.S. PATENT DOCUMENTS 7,834,972 B2 11/2010 Tseng et al.
8,174,662 B2 5/2012 Tseng et al.
(Continued)

FOREIGN PATENT DOCUMENTS

CN 101206323 A 6/2008
CN 101719352 A 6/2010
(Continued)

OTHER PUBLICATIONS

Chinese Office Action dated Apr. 8, 2019, from application No. 201710408231.X.
(Continued)

*Primary Examiner* — Michael J Eurice
(74) *Attorney, Agent, or Firm* — Arch & Lake LLP

(57) ABSTRACT

The present disclosure relates to a driving module for a display panel. The driving module includes a gate driver configured to output a scan signal according to a first input signal and comprising signal input terminals configured to receive the first input signal. The driving module includes a timing controller configured to provide the first input signal and comprising signal output terminals configured to output the first input signal. The driving module includes switching elements. A first terminal of each switching element is coupled to a corresponding one of the signal output terminals, a second terminal of each switching element is coupled
(Continued)

to a corresponding one of the signal input terminals, and a control terminal of each switching element is coupled to a first power terminal through a first resistor circuit or coupled to a second power terminal through a second resistor circuit.

15 Claims, 6 Drawing Sheets

(52) U.S. Cl.
CPC ..... *G09G 2310/08* (2013.01); *G09G 2330/02* (2013.01); *G09G 2330/12* (2013.01)

(58) Field of Classification Search
CPC ..... G09G 2310/06; G09G 2310/08; G09G 2330/12; G09G 2330/02
See application file for complete search history.

(56) References Cited

U.S. PATENT DOCUMENTS

| | | | |
|---|---|---|---|
| 9,697,779 | B2 | 7/2017 | Lu et al. |
| 2007/0216846 | A1 | 9/2007 | Tseng et al. |
| 2011/0025972 | A1 | 2/2011 | Tseng et al. |
| 2011/0037935 | A1 | 2/2011 | Tseng et al. |
| 2014/0071184 | A1 | 3/2014 | Lu et al. |

FOREIGN PATENT DOCUMENTS

| | | | |
|---|---|---|---|
| CN | 101884062 | A | 11/2010 |
| CN | 102842299 | A | 12/2012 |
| CN | 104505045 | A | 4/2015 |
| CN | 105489181 | A | 4/2016 |
| CN | 106128342 | A | 11/2016 |
| CN | 106228923 | A | 12/2016 |
| CN | 104505045 | B | 4/2017 |
| CN | 107038985 | A | 8/2017 |
| EP | 2 709 097 | A2 | 3/2014 |
| EP | 2 709 097 | A3 | 11/2016 |
| WO | WO-2016/106783 | A1 | 7/2016 |
| WO | WO-2017/117950 | A1 | 7/2017 |

OTHER PUBLICATIONS

International Search Report and Written Opinion dated Jul. 19, 2018, from application No. PCT/CN2018/086841.

DRIVING MODULE USED FOR DISPLAY PANEL, DISPLAY PANEL AND DISPLAY DEVICE

CROSS REFERENCE

The present application is a continued application of International Application No. PCT/CN2018/086841, filed on May 15, 2018, which is based upon and claims priority to Chinese Patent Application No. 201710408231.X, filed on Jun. 2, 2017, and the entire contents thereof are incorporated herein by reference.

TECHNICAL FIELD

The present disclosure relates to display technologies, and particularly to a driver module for a display panel, a display panel including the driver module, and a display device including the display panel.

BACKGROUND

Among liquid crystal display technologies developing rapidly at present, thin film transistor liquid crystal displays (TFT-LCDs) have been widely favored due to their advantages such as large capacity, high definition, and high quality full color. With the development of the liquid crystal display field, products are getting thinner and lighter, and integration of internal circuits becomes increasingly high. Common circuit integration schemes include: a timing control module (T-CON module) or a power function module is integrated in a source driver circuit, or the timing control module and the power function module are simultaneously integrated in the source driver circuit, so that components of an external circuit can be greatly reduced.

SUMMARY

Arrangements of the present disclosure provide a driver module for a display panel, a display panel including the above driver module, and a display device including the above display panel.

Other features and improvements of the present disclosure will be apparent from the following detailed description or be obtained from the practice of the present disclosure.

According to a first aspect of the present disclosure, there is provided a driver module for a display panel. The driver module includes a gate driver configured to output a scan signal according to a first input signal and including signal input terminals configured to receive the first input signal. The driver module includes a timing controller configured to provide the first input signal and including signal output terminals configured to output the first input signal. The driver module includes switching elements. A first terminal of each of the switching elements is coupled to a corresponding one of the signal output terminals, a second terminal of each of the switching elements is coupled to a corresponding one of the signal input terminals, and a control terminal of each of the switching elements is coupled to a first power terminal through a first resistor circuit or coupled to a second power terminal through a second resistor circuit.

In an exemplary arrangement of the present disclosure, the signal output terminals include N start signal output terminals and M clock signal output terminals. The signal input terminals include N start signal input terminals and M clock signal input terminals. The switching elements include N first switching elements and M second switching elements. A first terminal of an n-th first switching element is coupled to an n-th start signal output terminal, and a second terminal of the n-th first switching element is coupled to an n-th start signal input terminal. A first terminal of an m-th second switching element is coupled to an m-th clock signal output terminal, and a second terminal of the m-th second switching element is coupled to an m-th clock signal input terminal. In some arrangements, $m \in M$, $n \in N$, and M, N, m, and n are positive integers.

In an exemplary arrangement of the present disclosure, the first resistor circuit includes one first resistor and the second resistor circuit includes one second resistor. Control terminals of the n-th first switching element and the m-th second switching elements are coupled to the first power terminal through the first resistor, or coupled to the second power terminal through the second resistor.

In an exemplary arrangement of the present disclosure, the first resistor circuit includes N+M first resistors, and the second resistor circuit includes N+M second resistors. A control terminal of each of the first switching elements is coupled to the first power terminal through a corresponding one of the first resistors, or coupled to the second power terminal through a corresponding one of the second resistors. A control terminal of each of the second switching elements is coupled to the first power terminal through a corresponding one of the first resistors, or coupled to the second power terminal through a corresponding one of the second resistors. In an exemplary arrangement of the present disclosure, the display panel further includes an array substrate. The array substrate includes a display region and a peripheral region disposed at a periphery of the display region. The gate driver is formed at the peripheral region, and the gate driver is a GOA circuit.

In an exemplary arrangement of the present disclosure, the display region includes sub-pixels arranged in an array. Each of the sub-pixels includes a third switching element. The third switching element, the first switching element and the second switching element are thin film transistors. Each of the thin film transistors includes a gate layer, a gate insulating layer, an active layer, and a source and drain metal layer which are stacked. Gate layers, gate insulating layers, active layers, and source and drain metal layers of the first switching element and the second switching element and a gate layer, a gate insulating layer, an active layer, and a source and drain metal layer of the third switching element are arranged in the same layers, respectively.

In an exemplary arrangement of the present disclosure, the timing controller and a source driver are integrated on an IC driver module.

In an exemplary arrangement of the present disclosure, test pins are disposed between the timing controller and the switching elements. An input terminal of each of the test pins is coupled to one of the signal output terminals, and an output terminal of each of the test pins is coupled to a first terminal of a corresponding one the switching elements.

According to a second aspect of the present disclosure, there is provided a display panel including the above driver module for the display panel.

According to a third aspect of the present disclosure, there is provided a display device including the above display panel.

The above general description and the following detailed description are merely exemplary and explanatory and should not be construed as limiting of the disclosure.

BRIEF DESCRIPTION OF THE DRAWINGS

The drawings, which are incorporated in the specification and constitute a part of the specification, show exemplary arrangements of the present disclosure. The drawings along with the specification explain the principles of the present disclosure. It is apparent that the drawings in the following description show only some of the arrangements of the present disclosure, and other drawings may be obtained by those skilled in the art without departing from the drawings described herein.

DETAILED DESCRIPTION

Example arrangements will now be described more fully with reference to the accompanying drawings. However, the example arrangements can be embodied in a variety of forms and should not be construed as being limited to the examples set forth herein; rather, these arrangements are provided so that the present disclosure will be more comprehensive and complete, and the conception of the example arrangements will be conveyed to those skilled in the art fully. The described features, structures, or characteristics may be combined in one or more arrangements in any suitable manner. In the following description, numerous specific details are set forth to facilitate understanding of arrangements of the present disclosure. However, one skilled in the art will appreciate that the technical solutions of the present disclosure may be implemented when one or more of the specific details are omitted, or other methods, components, devices, steps, and the like may be employed. In other instances, the well-known technical solutions would not be shown or described in detail so as to avoid various aspects of the present disclosure to be obscured.

Although the relative terms such as "upper" and "lower" are used in the specification to describe the relative relationship of one component in a figure to another component, these terms are used in this specification for convenience only, for example, according to a direction as described in the examples of the accompanying drawings. It will be understood that if a device in a figure is flipped upside down, an upper component described above will become a "lower" component. When a structure is referred to as being "on" another structure, it is possible that the structure is integrally formed on the another structure, or that the structure is "directly" disposed on the another structure, or that the structure is "indirectly" disposed the another structure through other structure(s).

The terms "a", "an", "the" and "said" mean the presence of one or more elements/components, or the like; the terms "including" and "having" should be understood in an open sense and means that there may be additional elements/components in addition to the listed elements/components. The terms "first", "second" and the like are used to distinguish different objects but not for limiting the number of objects.

Figure 1:
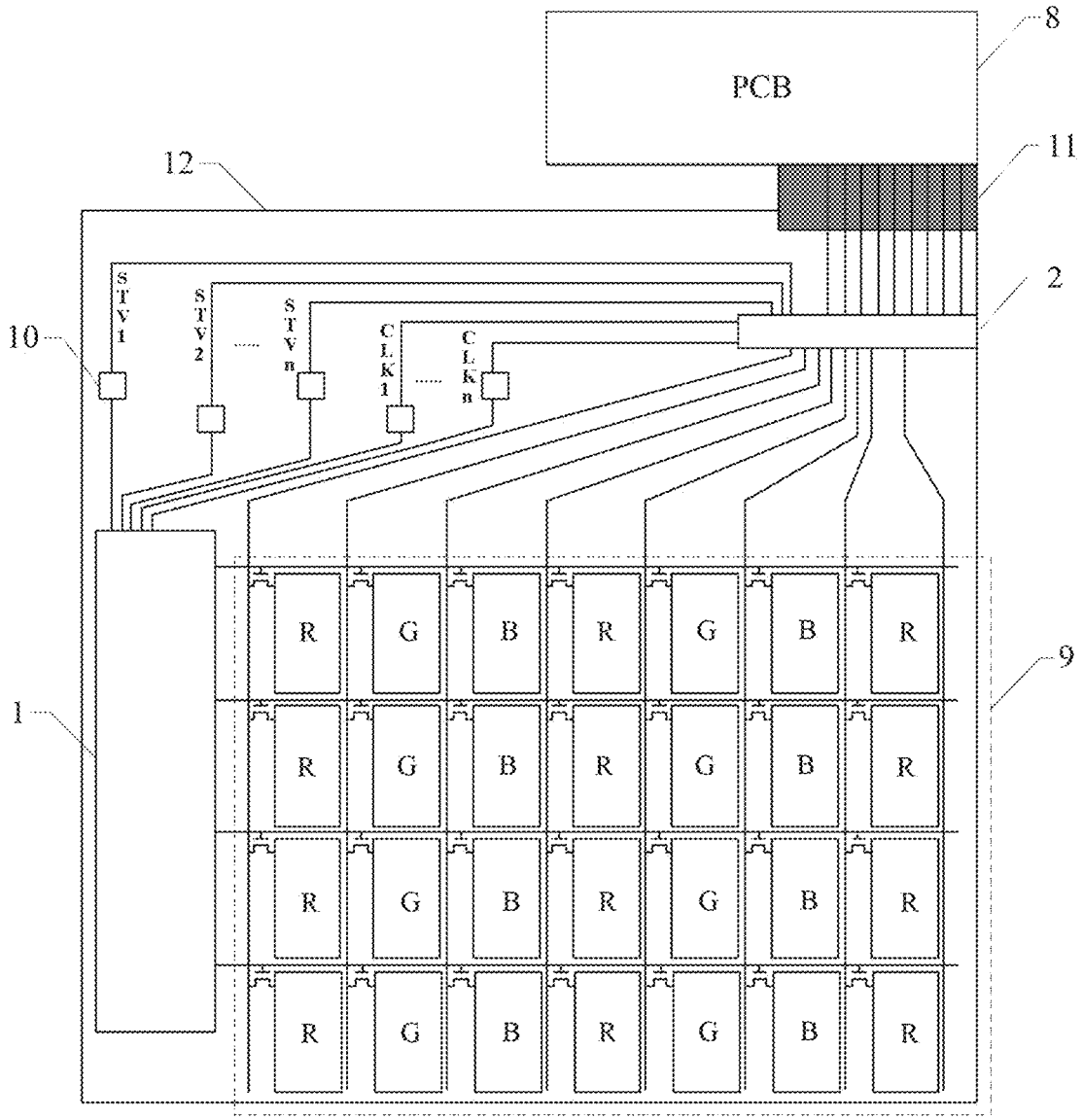
FIG. 1 is a schematic view showing a structure of a display panel GOA provided by the prior art.

Although the degree of integration of the external circuit in related arts can be improved, there is a problem that it is difficult to determine positions where defects occur when the products have defects. For example, referring to FIG. 1, when a voltage is abnormally pulled, the pulling of the voltage may be caused by an abnormality in the source driver circuit or an abnormality at the panel because GOA signals such as clock signals and start signals are coupled to a panel through panel trace from one terminal of the source driver circuit. If the specific position of the abnormality needs to be further determined, the trace between the source driver circuit and the panel end needs to be cut off. If the specific position where the defect occurs is at the panel, the difficulty of the analysis is increased since a control signal cannot be input to the panel. At this time, a PCB board where the source driver circuit is integrated needs to be returned to the factory to confirm whether there is no defect in this part, and then the defect position of the panel is determined in the factory. This may greatly prolong the analysis period, which is disadvantageous for avoidance of defects at the panel end and quick and effective response to customer complaints.

In the production process and subsequent warranty process of the existing thin film transistor liquid crystal displays (TFT-LCDs), the liquid crystal displays (LCDs) often have defects associated with a voltage drop, such as black screen, splash screen, and the like. This type of defects which are generated because a voltage is pulled are generally related to both an IC driver circuit and the panel, and thus the positions of the detects cannot be directly determined. If the trace(s) connecting the IC driver circuit and the panel is(are) directly cut off, the subsequent analysis would be affected and the difficulty of analysis would be increased; if the trace(s) connecting the IC driver circuit and the panel is(are) not directly cut off, any association needs to be excluded, and as a result, the positions of the defects are difficult to determine, and the analysis time will be prolonged. This will reduce the analysis efficiency, and cause customer complaints and other serious consequences.

Figure 2:
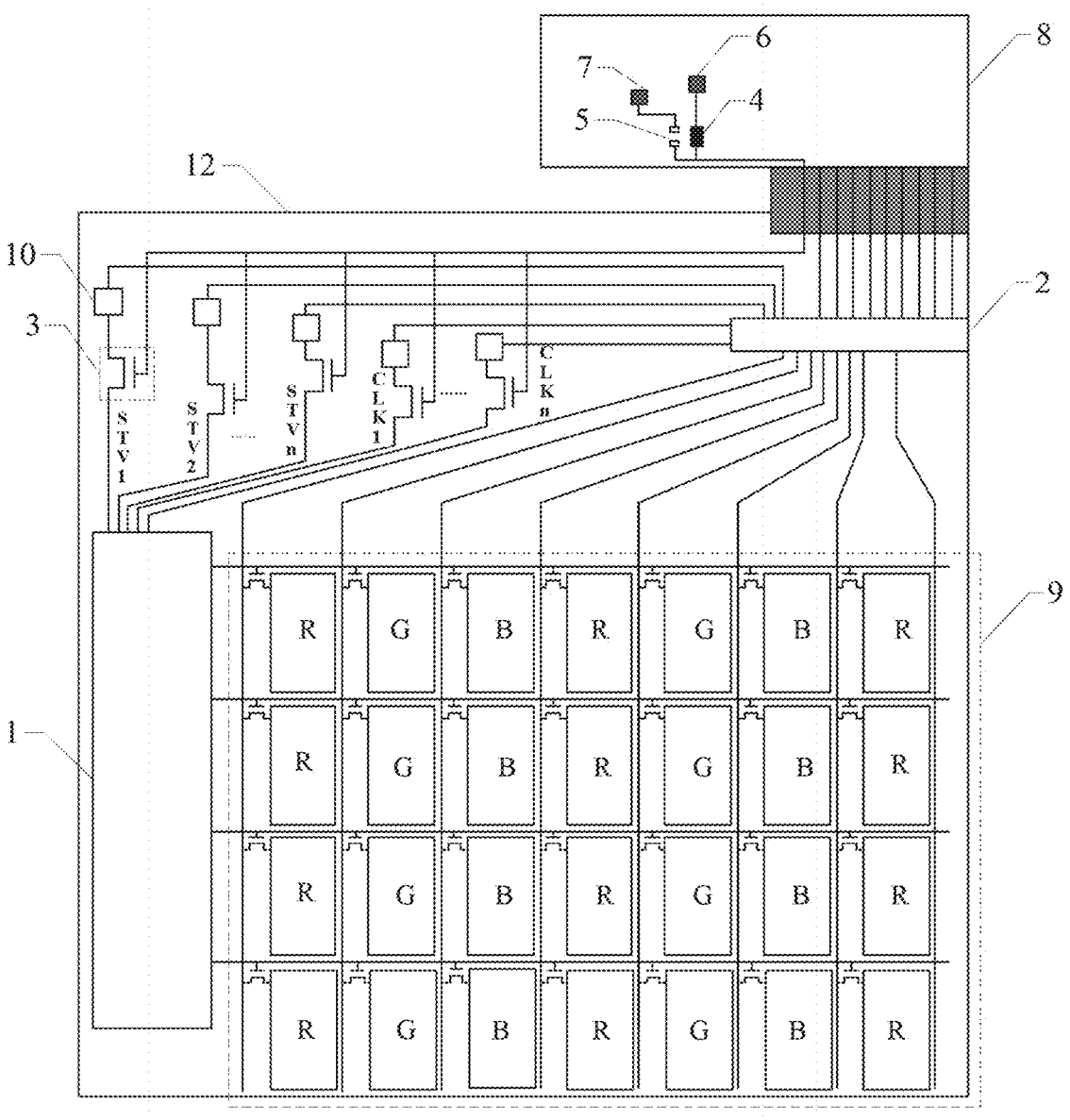
FIG. 2 is a schematic view showing a structure of a driver module for a display panel according to an exemplary arrangement of the present disclosure.

In an exemplary arrangement of the present disclosure, a driver module for a display panel is provided, which can be applied to a display panel such as an LED, an LCD or the like. Referring to FIG. 2, the driver module may include a gate driver 1, a timing controller 2, and switching elements 3.

The gate driver 1 is configured to output a scan signal according to a first input signal and including signal input terminals configured to receive the first input signal.

The timing controller 2 is configured to provide the first input signal and includes signal output terminals configured to output the first input signal.

A first terminal of each of the switching elements 3 is coupled to a corresponding one of the signal output terminals, a second terminal of each of the switching elements 3 is coupled to a corresponding one of the signal input terminals, and a control terminal of each of the switching elements 3 is coupled to a first power terminal 6 through a first resistor circuit which may include one or more first resistors 4 or coupled to a second power terminal 7 through a second resistor circuit which may include one or more second resistors 5.

In the driver module for the display panel provided by arrangements of the present disclosure, by disposing the switching elements at the trace(s) between the gate driver and the timing controller, the driver module can realize the control of the on or off action of the GOA signals to the panel by using the switching elements. And, the control terminals of the switching elements are coupled to the first power terminal through the first resistor circuit or coupled to the second power terminal through the second resistor circuit. When there are defects and the defects need to be positioned, only the connection of the control terminals of the switching elements to the first power or the second power is switched, and the specific positions of the defects can be determined by measuring the voltages of the control terminals or measuring the GOA signals at the test points without disassembling the display panel. Thus, the present disclosure can achieve quick location of the defects, reduce the difficulty in analyzing of the defect positioning and shorten the defects analysis time.

In the driver module for the display panel provided by the example arrangement, when defects occur and the defects need to be positioned, the connection of the control terminals of the switching elements 3 to the first power terminal 6 or the second power terminal 7 is switched, and the specific positions can be determined by measuring the voltages of the control terminals or by measuring the GOA signals at the test points without disassembling the display panel, and this can achieve quick positioning of the defects, reduce the difficulty in analyzing the positions of the defects and shorten the defect analysis time.

Hereinafter, the driver module for the display panel in the present exemplary arrangement will be described in more detail with reference to FIGS. 2 to 8.

Figure 3:
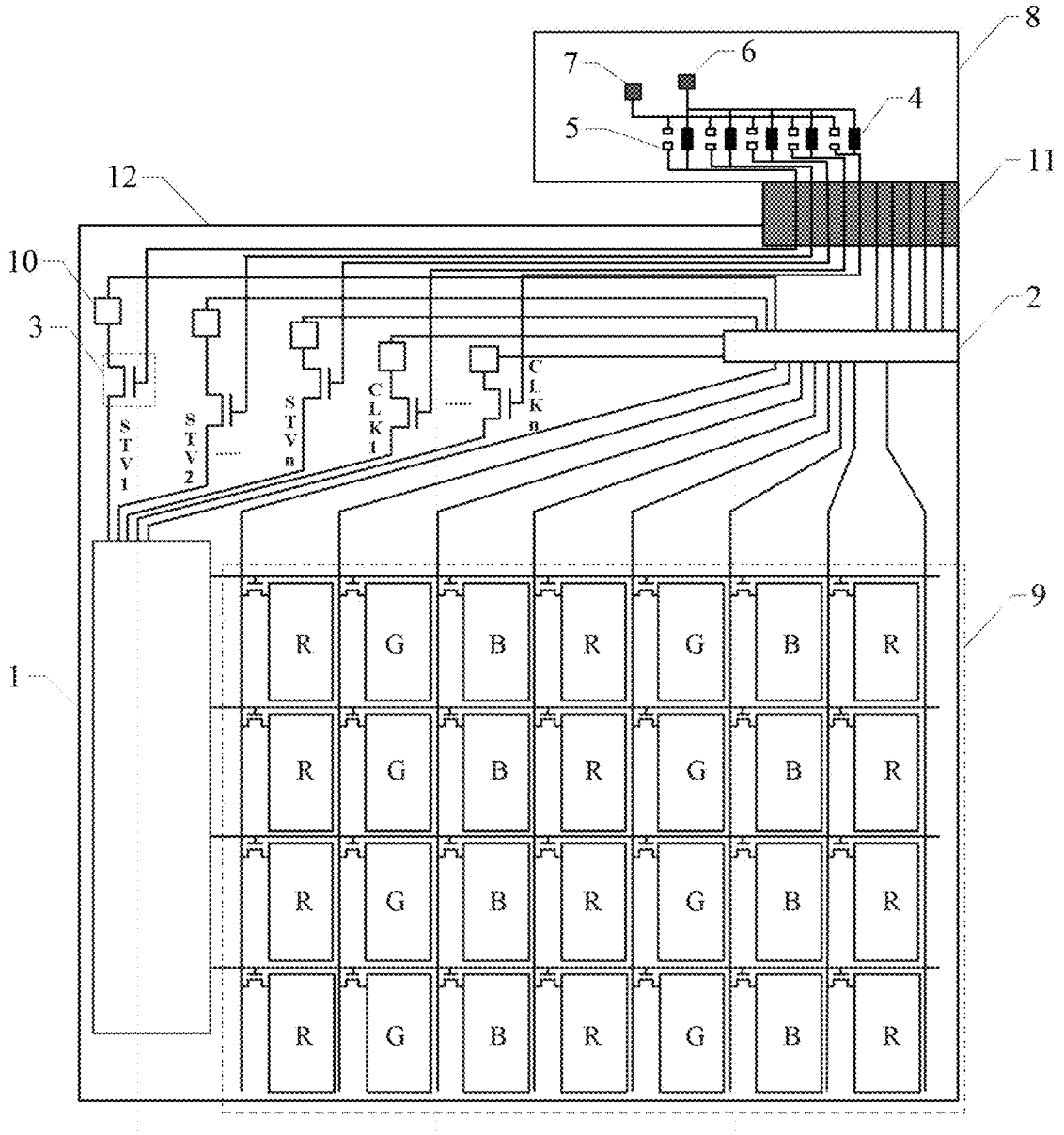
FIG. 3 is a schematic view showing another structure of a driver module for a display panel according to an exemplary arrangement of the present disclosure.
Figure 4:
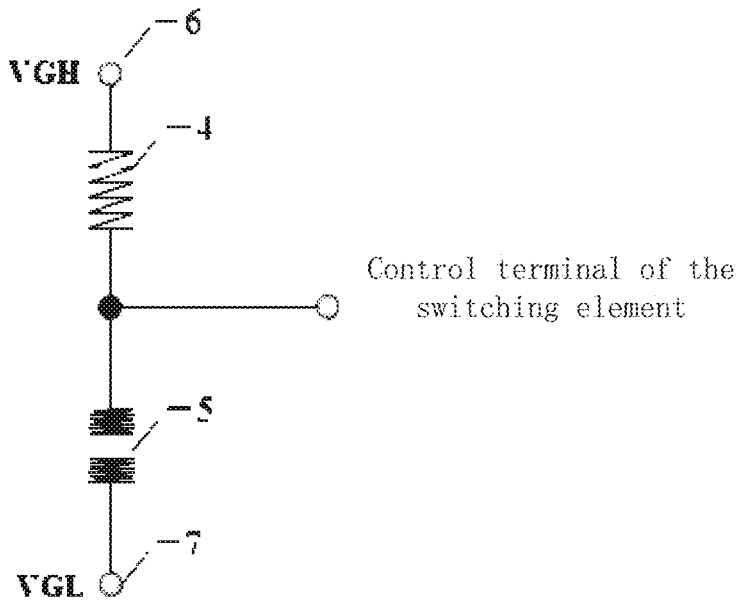
FIG. 4 is a schematic view showing a connection when a switching element is turned on according to an exemplary arrangement of the present disclosure.

Referring to FIG. 2 and FIG. 3, test pins 10 may be disposed between the timing controller 2 and the switching elements 3. An input terminal of each of the test pins 10 are coupled to a corresponding one of the signal output terminals, and an output terminal of each of the test pins 10 is coupled to the first terminal of a corresponding one of the switching elements 3.

In the above arrangement, in the above driver module, the signal output terminals include N start signal output terminals and M clock signal output terminals; the signal input terminals correspond to the signal output terminals and include N start signal input terminals and M clocks a signal input terminal.

The switching elements include N first switching elements and M second switching elements. A first terminal of an n-th first switching element is coupled to an n-th start signal output terminal, and a second terminal of the n-th first switching element is coupled to an n-th start signal input terminal; a first terminal of an m-th second switching element is coupled to an m-th clock signal output terminal, and a second terminal of the m-th second switching element is coupled to an m-th clock signal input terminal, wherein $m \in M$, $n \in N$; and M, N, m, and n are all positive integers.

For example, N=3, M=2, that is, the signal output terminals include three start signal output terminals and two clock signal output terminals, and the signal input terminals include three start signal input terminals and two clock signal input terminals; and the switching elements 3 include three first switching elements and two second switching elements. The first one of the first switching elements is disposed at a trace between the first start signal output terminal and the first start signal input terminal; the second one of the first switching elements is disposed at a trace between the second start signal output terminal and the second start signal input terminal; the third one of the first switching elements is disposed at a trace between the third start signal output terminal and the third start signal input terminal. The first one of the second switching elements is disposed at a trace between the first clock signal output terminal and the first clock signal input terminal; the second one of the second switching elements is disposed at a trace between the second clock signal output terminal and the second clock signal input terminal.

As another example, N=5, M=1, that is, the signal output terminals include five start signal output terminals and one clock signal output terminals, and the signal input terminals include five start signal input terminals and one clock signal input terminals; and the switching elements 3 include five first switching elements and one second switching elements. One of the first switching elements is disposed at a trace between each of the start signal output terminals and each of the start signal input terminals. One second switching element is disposed between the clock signal output terminal and the clock signal input terminal. In other exemplary arrangements of the present disclosure, according to the specific situation of the display panel, the number of required first switching elements and second switching elements may also be determined according to the start signal traces and the clock signal traces included in the display panel. The present disclosure does not specifically limit the number of the start signal output terminals, the clock signal output terminals, and the switching elements.

Referring to FIG. 2 and FIG. 3, at the start signal traces (STV traces) between the start signal output terminals and the start signal input terminals, such as $STV_1$, $STV_2$, . . . $STV_n$ and the clock signal traces (CLK traces) between the clock signal output terminals and the clock signal input terminals, such as $CLK_1$, $CLK_2$, . . . $CLK_n$, the switching elements 3 are disposed at each start signal trace and each clock signal trace. By disposing the switching element 3 at the start signal traces and the clock signal traces, input of the start signals or the clock signals to the panel can be enabled or disabled by the switching elements 3.

Based on the above, in the present exemplary arrangement, referring to FIG. 2, the control terminals of the N first switching elements and the M second switching elements are coupled to the first power terminal 6 through the first resistor 4 or coupled to the second power terminal 7 through the second resistor 5.

That is, the control terminals of the switching elements 3 at the traces between the signal output terminals and the signal input terminals are coupled to the same first resistor 4, and is coupled to the first power terminal 6 through the first resistor 4, or the control terminals of the switching elements 3 are coupled to the same second resistor 5, and is coupled to the second power terminal 7 through the second resistor 5.

The first resistor 4 and the second resistor 5 may be resistors having a resistance value of 0 ohm. The first power terminal 6 may be a high level terminal, and the second power terminal 7 may be a low level terminal. In normal operation, referring to FIG. 4, the control terminal of each switching element 3 can be coupled to the high level terminal through the first resistor 4, the switching element 3 is in an on state, and the first input signal outputted from a corresponding one of the signal output terminals can be input to a corresponding signal input terminal at the panel to make the display panel work normally, and realize the display function without affecting any test or signal conduction.

Figure 5:
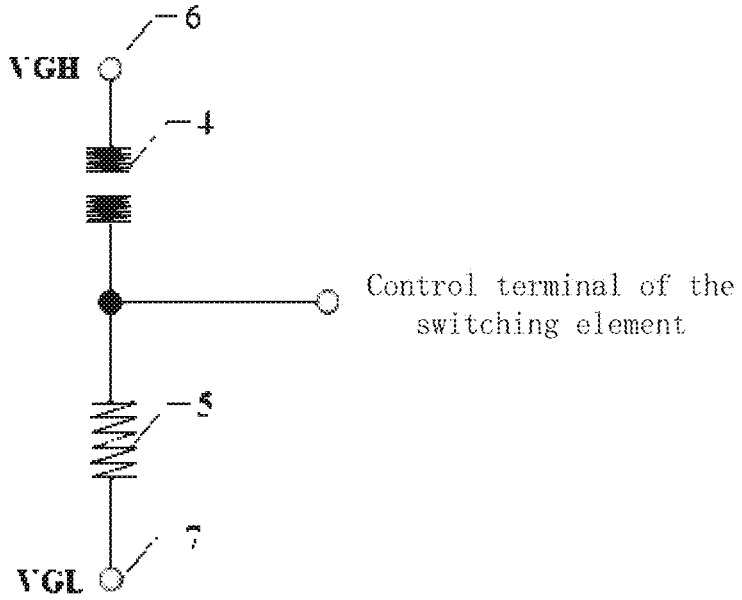
FIG. 5 is a schematic view showing a connection of a switching element when test is performed according to an exemplary arrangement of the present disclosure.

When the occurrence of a defect induces the voltage drop and the defect needs to be positioned, referring to FIG. 5, the control terminal of each switching element 3 can be coupled to the second power terminal 7 through the second resistor 5, that is, the low level terminal (VGL). At this time, the switching element 3 is in an off state, and the connection between the corresponding signal output terminal and the corresponding signal input terminal is cut off. At this time, whether the output of the first input signal is the abnormal can be determined by measuring the voltage at the signal output terminal or detecting the GOA signal on the test pin (ET Pad) 10. If there is no abnormality in the signal, it means that the pulling of the voltage is caused by the panel. To restore the initial state to enable line patrol of the panel, the control terminal of the switching element 3 can be coupled to the first resistor 4 and thus to the first power terminal through the first resistor 4, that is, the high level terminal (VGH).

By disposing the first resistor 4 and the second resistor, it is convenient to switch the control terminal of the switching element 3 between the high level terminal and the low level terminal when the defects occur, and the process can be completed by manual welding. With regard to the operation aspect, the operational difficulty of directly switching the trace between the high terminal and the low terminal is avoided.

In other exemplary arrangements of the present disclosure, as shown in FIG. 3, the first resistor circuit includes N+M first resistors and the second resistor circuit includes N+M second resistors. The control terminal of each first switching element is coupled to the first power terminal through one of the first resistors, or is coupled to the second power terminal through one of the second resistors; the control terminal of each second switching element is coupled to the first power terminal through one of the first resistors, or coupled to the second power terminal through one of the second resistors. That is, each of the switching elements 3 is coupled to one of the first resistors 4 or one of the second resistors 5, the first resistors 4 are coupled to the first power terminal 6, and the second resistors 5 are coupled to the second power terminal 7.

Figure 6:
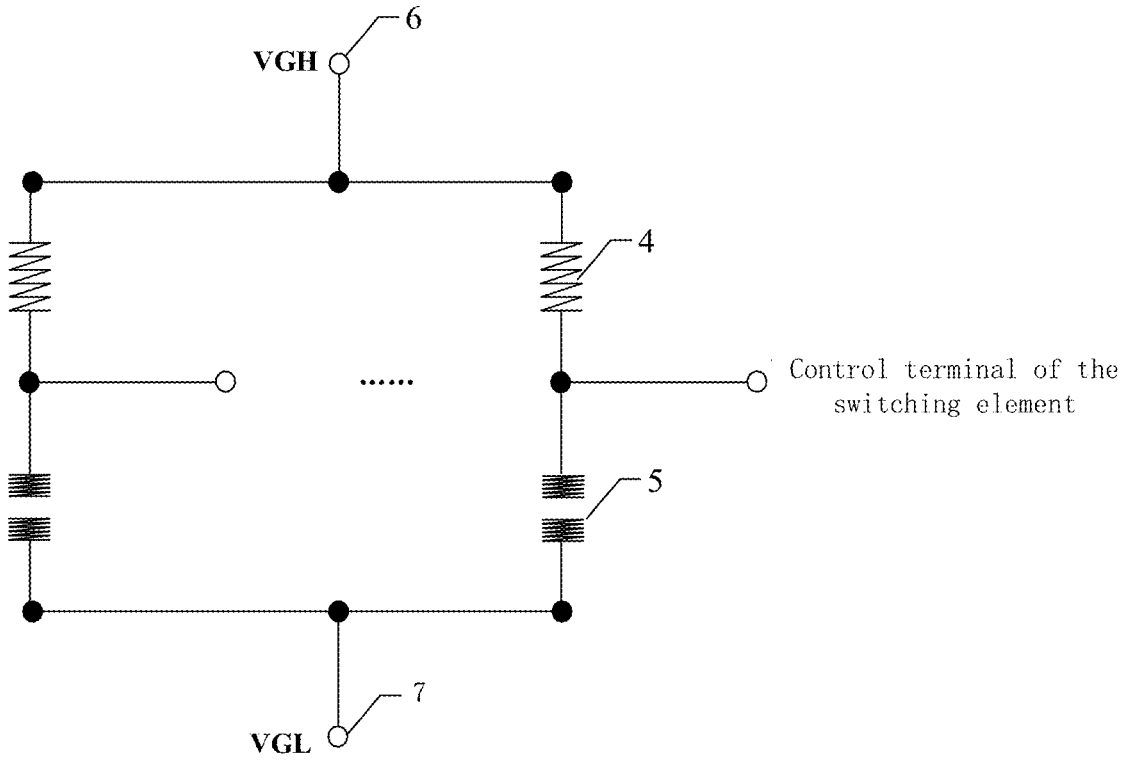
FIG. 6 is a schematic view showing another connection when the switching element is turned on according to an exemplary arrangement of the present disclosure.
Figure 7:
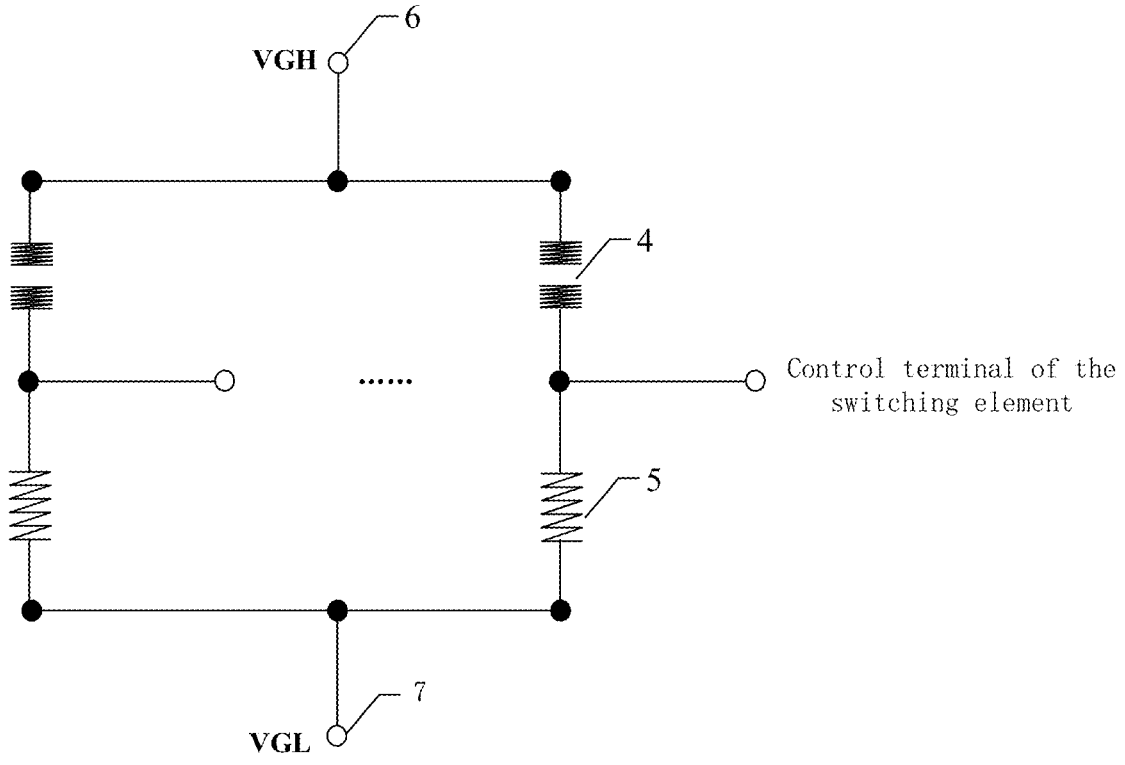
FIG. 7 is a schematic view showing another connection of a switching element when test is performed according to an exemplary arrangement of the present disclosure.

In the arrangement, each of the switching elements 3 corresponds to a first resistor 4 and a second resistor 5, referring to FIG. 6, the control terminal of each switching element 3 is coupled to one of the first resistors 4. The switching element is thus coupled to the high level terminal 6 through the first resistor 4, and at this time, the switching element 3 is in an on state, and the display panel operates normally. When the GOA signal on a single trace needs to be closed for determination, referring to FIG. 7, the control terminal of the switching element 3 can be coupled to the low level terminal (VGL) through the second resistor 5 while being disconnected from the high level terminal without affecting the transmission of signals on other traces.

In the present exemplary arrangement, referring to FIG. 2 and FIG. 3, the above display panel may include an array substrate, the array substrate includes a display region 9 and a peripheral region disposed at a periphery of the display region 9. The gate driver 1 may be formed in the peripheral region, and the gate driver may be a GOA circuit. The timing controller 2 and the source driver are integrated on an integrated circuit (IC) driver module, and the IC driver module may be formed in the peripheral region. Meanwhile, the above first resistor(s) 4, the second resistor(s) 5, the first power terminal 6, and the second power terminal 7 may be integrated on the PCB board 8 as a matching circuit for controlling the switching element 3. The PCB board 8 can be coupled to the peripheral region through the flexible circuit board 11. By forming the gate driver 1 and the IC driver module in the peripheral region, the integration degree can be effectively improved, and the space occupied by the peripheral region can be reduced, so that the narrow bezel design of the display panel can be realized.

Figure 8:
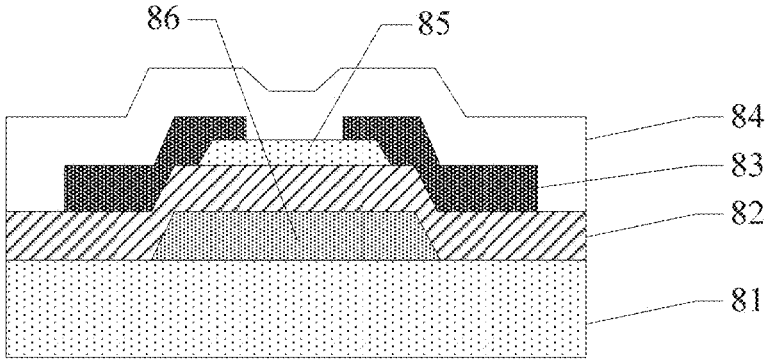
FIG. 8 is a schematic view showing a structure of a thin film transistor according to an exemplary arrangement of the present disclosure.

Based on the above, in the exemplary arrangements, the display region includes sub-pixels arranged in an array. Each of the sub-pixels includes a third switching element. Referring to FIG. 8, the third switching element, the first switching element and the second switching element are all thin film transistors, and each of the thin film transistors includes a gate layer 86, a gate insulating layer 82, an active layer 85, and a source and drain metal layer 83 which are stacked.

The source electrodes of the first switching element and the second switching element are coupled to the signal output terminals; the drain electrodes of the first switching element and the second switching element are coupled to the signal input terminals; the gate electrodes of the first switching element and the second switching element are coupled to the PCB board 8 or the flexible circuit board 11 by the traces, and are thus coupled to the high level terminal or the low level terminal.

The gate layers, the gate insulating layers, the active layers, and the source and drain metal layers of the first switching element and the second switching element and the gate layer, the gate insulating layer, the active layer, and the source and drain metal layer of the third switching element are disposed in the same layers, respectively.

The thin film transistors may be N-type TFTs or P-type TFTs, which is not particularly limited in the exemplary arrangements. In addition, it is easily understood by those skilled in the art that the order of the layers of the thin film transistors in the present exemplary arrangements is not particularly limited. For example, the thin film transistors may be of a top gate type or a bottom gate type, which both fall within the protection scope of the present disclosure.

By disposing the layers of the first switching element and the second switching element and the corresponding layers of the third switching element in the same layers, the same layers of the switching elements can be formed in the same photolithography process, which can effectively simplify the process and thus reduce the costs.

Further, in the arrangement of the present disclosure, a display panel including the above driver module is further provided.

By disposing the above driver module in the display panel, the switching elements 3 can be used to enable the transmission of the GOA signals to the panel. When defects occur and the positions of the defects need to be determined, whether there is an abnormality in the output of the IC driver module may be determined by switching the connection of the control terminal of the switching element 3 between the first power terminal 6 and the second power terminal 7 and measuring the voltage on the PCB board 8 or the flexible circuit board 11 or testing the GOA signals on the test pins (ET Pad) 10, thus greatly shortening the defect analysis time.

Further, in the arrangement of the present disclosure, a display device including the above display panel is further provided.

In the present exemplary arrangement, the display device may include any product or component having a display function, such as a mobile phone, a tablet computer, a television, a notebook computer, a digital photo frame, a navigator, and the like.

Other arrangements of the present disclosure will be apparent to those skilled in the art when considering the specification and practicing the disclosure described herein. The present application is intended to cover any variations, uses, or adaptations of the present disclosure, which are in accordance with the general principles of the present disclosure and include common knowledge or customary means in the art that are not disclosed in the present disclosure. The specification and examples are intended to be regarded as illustrative only, and the turn scope and spirit are defined by the accompanying claims.

What is claimed is:

1. A driver module for a display panel, comprising:

a gate driver configured to output a scan signal according to a first input signal and comprising signal input terminals configured to receive the first input signal;

a timing controller configured to provide the first input signal and comprising signal output terminals configured to output the first input signal; and switching elements, wherein a first terminal of each of the switching elements is coupled to a corresponding one of the signal output terminals of the timing controller, a second terminal of each of the switching elements is coupled to a corresponding one of the signal input terminals of the gate driver, and a control terminal of each of the switching elements is coupled to a first power terminal through a first resistor circuit or coupled to a second power terminal through a second resistor circuit, and wherein:

the signal output terminals comprise N start signal output terminals and M clock signal output terminals; the signal input terminals comprise N start signal input terminals and M clock signal input terminals; the switching elements comprise N first switching elements and M second switching elements;

a first terminal of an n-th first switching element is coupled to an n-th start signal output terminal, and a second terminal of the n-th first switching element is coupled to an n-th start signal input terminal; and a first terminal of an m-th second switching element is coupled to an m-th clock signal output terminal, and a second terminal of the m-th second switching element is coupled to an m-th clock signal input terminal;

wherein $m \in M$, $n \in N$; and M, N, m, and n are positive integers.

2. The driver module for a display panel according to claim 1, wherein the timing controller and a source driver are integrated on an integrated circuit (IC) driver module.

3. The driver module for a display panel according to claim 1, wherein test pins are disposed between the timing controller and the switching elements;

an input terminal of each of the test pins is coupled to one of the signal output terminals, and an output terminal of each of the test pins is coupled to a first terminal of a corresponding one the switching elements.

4. The driver module for a display panel according to claim 1, wherein the first resistor circuit comprises one first resistor and the second resistor circuit comprises one second resistor, respective control terminals of the n-th first switching element and the m-th second switching elements are coupled to the first power terminal through the first resistor, or coupled to the second power terminal through the second resistor.

5. The driver module for a display panel according to claim 1, wherein:

the first resistor circuit comprises N+M first resistors, and the second resistor circuit comprise N+M second resistors; wherein a control terminal of each of the first switching elements is coupled to the first power terminal through a corresponding one of the first resistors, or coupled to the second power terminal through a corresponding one of the second resistors;

a control terminal of each of the second switching elements is coupled to the first power terminal through a corresponding one of the first resistors, or coupled to the second power terminal through a corresponding one of the second resistors.

6. The driver module for a display panel according to claim 1, wherein the display panel further comprises an array substrate, the array substrate comprises a display region and a peripheral region disposed at a periphery of the display region;

wherein the gate driver is formed at the peripheral region, and the gate driver is a GOA circuit.

7. The driver module for a display panel according to claim 6, wherein the display region comprises sub-pixels arranged in an array, each of the sub-pixels comprises a third switching element; wherein the third switching element, the first switching element and the second switching element are all thin film transistors each of which comprises a gate layer, a gate insulating layer, an active layer, and a source and drain metal layer which are stacked; and wherein gate layers, gate insulating layers, active layers, and source and drain metal layers of the first switching element and the second switching element and a gate layer, a gate insulating layer, an active layer, and a source and drain metal layer of the third switching element are arranged in the same layers, respectively.

8. A display panel, comprising a driver module;

wherein the driver module comprises:

a gate driver configured to output a scan signal according to a first input signal and comprising signal input terminals configured to receive the first input signal;

a timing controller configured to provide the first input signal and comprising signal output terminals configured to output the first input signal; and switching elements, wherein a first terminal of each of the switching elements is coupled to a corresponding one of the signal output terminals of the timing controller, a second terminal of each of the switching elements is coupled to a corresponding one of the signal input terminals of the gate driver, and a control terminal of each of the switching elements is coupled to a first power terminal through a first resistor circuit or coupled to a second power terminal through a second resistor circuit, and wherein:

the signal output terminals comprise N start signal output terminals and M clock signal output terminals; the signal input terminals comprise N start signal input terminals and M clock signal input terminals; the switching elements comprise N first switching elements and M second switching elements;

a first terminal of an n-th first switching element is coupled to an n-th start signal output terminal, and a second terminal of the n-th first switching element is coupled to an n-th start signal input terminal; and a first terminal of an m-th second switching element is coupled to an m-th clock signal output terminal, and a second terminal of the m-th second switching element is coupled to an m-th clock signal input terminal;

wherein m∈M, n∈N; and M, N, m, and n are positive integers.

9. The display panel according to claim 8, wherein the timing controller and a source driver are integrated on an integrated circuit (IC) driver module.

10. The display panel according to claim 8, wherein test pins are disposed between the timing controller and the switching elements;

an input terminal of each of the test pins is coupled to one of the signal output terminals, and an output terminal of each of the test pins is coupled to a first terminal of a corresponding one the switching elements.

11. The display panel according to claim 8, wherein the first resistor circuit comprises one first resistor and the second resistor circuit comprises one second resistor, control terminals of the n-th first switching element and the m-th second switching elements are coupled to the first power terminal through the first resistor, or coupled to the second power terminal through the second resistor.

12. The display panel according to claim 8, wherein:

the first resistor circuit comprises N+M first resistors, and the second resistor circuit comprise N+M second resistors; wherein a control terminal of each of the first switching elements is coupled to the first power terminal through a corresponding one of the first resistors, or coupled to the second power terminal through a corresponding one of the second resistors;

a control terminal of each of the second switching elements is coupled to the first power terminal through a corresponding one of the first resistors, or coupled to the second power terminal through a corresponding one of the second resistors.

13. The display panel according to claim 8, wherein the display panel further comprises an array substrate, the array substrate comprises a display region and a peripheral region disposed at a periphery of the display region;

wherein the gate driver is formed at the peripheral region, and the gate driver is a GOA circuit.

14. The display panel according to claim 13, wherein the display region comprises sub-pixels arranged in an array, each of the sub-pixels comprises a third switching element; wherein the third switching element, the first switching element and the second switching element are all thin film transistors each of which comprises a gate layer, a gate insulating layer, an active layer, and a source and drain metal layer which are stacked; and wherein gate layers, gate insulating layers, active layers, and source and drain metal layers of the first switching element and the second switching element and a gate layer, a gate insulating layer, an active layer, and a source and drain metal layer of the third switching element are arranged in the same layers, respectively.

15. A display device, comprising the display panel of claim 8.

* * * * *